US006516715B1

(12) United States Patent
Reiche

(10) Patent No.: US 6,516,715 B1
(45) Date of Patent: Feb. 11, 2003

(54) DEVICE FOR TENSIONING AND CLOSING TIGHTENING STRAPS

(75) Inventor: Udo Reiche, Bornheim (DE)

(73) Assignee: Cyklop GmbH, Cologne (DE)

( * ) Notice: Subject to any disclaimer, the term of this patent is extended or adjusted under 35 U.S.C. 154(b) by 0 days.

(21) Appl. No.: 09/889,118

(22) PCT Filed: Feb. 1, 2000

(86) PCT No.: PCT/EP00/00807

§ 371 (c)(1),
(2), (4) Date: Jul. 10, 2001

(87) PCT Pub. No.: WO00/53500

PCT Pub. Date: Sep. 14, 2000

(30) Foreign Application Priority Data

Mar. 5, 1999 (DE) ..... 199 09 620

(51) Int. Cl.[7] ..... B65B 13/24

(52) U.S. Cl. ..... 100/29; 53/592; 100/33 PB; 140/93.2

(58) Field of Search ..... 53/582, 592, DIG. 2; 100/29, 33 PB; 140/93.2

(56) References Cited

U.S. PATENT DOCUMENTS 4,313,779 A * 2/1982 Nix ..... 100/33 PB
5,058,365 A * 10/1991 Kagi ..... 100/33 PB X
5,689,943 A * 11/1997 Wehr ..... 53/592
5,954,899 A * 9/1999 Figiel et al. ..... 100/33 PB

FOREIGN PATENT DOCUMENTS

DE 12 23 746 3/1967
DE 93 16 072.0 2/1994

OTHER PUBLICATIONS

International Search Report, dated May 2, 2000.

* cited by examiner

*Primary Examiner*—W. Donald Bray
(74) *Attorney, Agent, or Firm*—Fay, Sharpe, Fagan, Minnich & McKee

(57) ABSTRACT

An apparatus for tensioning and closing of a tightening strap for package tightenings. The apparatus comprising a closing device for connecting two ends of the strap and a tensioning device having a tensioning wheel that can be driven, a pressure plate which can be moved against the tensioning wheel or lifted from the tensioning wheel, and a self-adjusting separating element which is arranged between the tensioning wheel and the pressure plate, whereby one end of the strap is taken up between said tensioning wheel and the separating element, and the other end of the strap is taken up between the separating element and said pressure plate, the apparatus further including an unblocking element which displaces the separating element during the lifting of the pressure plate from the tensioning wheel. The displacement being approximately parallel to the two ends of the strap.

20 Claims, 5 Drawing Sheets

DEVICE FOR TENSIONING AND CLOSING TIGHTENING STRAPS

This application claims priority based upon German Application Ser. No. DE 199 09 620 1, filed Mar. 5, 1999, and PCT/EP00/00807, filed Feb. 1, 2000.

BACKGROUND OF THE INVENTION

This invention relates to an apparatus for tensioning and closing tightening straps, in particular made of plastics, for tightening packages. This apparatus further includes a closing device for connecting the two ends of the tightening strap and a tensioning device which consists essentially of a tensioning wheel, which can be driven, a pressure plate, which can be moved against the tensioning wheel or lifted therefrom, and a self adjusting separating element, which is arranged between these two parts, whereby one end of the strap is received between the tensioning wheel and the separating element, and the other end of the strap is received between this and the pressure plate.

Such an apparatus serves to provide a package as for example a packed pallet or a large carton with a tightening, and to hold together the goods which are stacked on the pallet or packed into the carton and to secure them for transport. For the production of the tightening, a rigid strap, usually of plastics, is placed around the package, and then the ends of the strap are tensioned against one another with the help of the apparatus and are connected to one another when the desired tension is reached. The connection takes place with the help of the closing device, which consists generally of a friction welding device for plastic straps. The ends of the strap are threaded laterally into the tensioning device for tensioning, whereby the lower end of the strap lies between the pressure plate and the separating element, and the upper second end of the strap lies between the separating element and the tensioning wheel. The tensioning wheel, which is usually provided with barbs at its peripheral surface, or which is roughened in another way, is rotated by means of a suitable drive and draws the upper end of the strap through the apparatus into the closing device which is arranged behind the tensioning device, while the lower end of the strap is held in a clamping manner between the pressure plate and the separating element. The separating element is mounted in the tensioning device in a self-adjusting manner, that is, it can move within certain limits during the tensioning process, and so take up an optimal position relative to the tensioning wheel, so that the friction closure between the tensioning wheel and the upper end of the strap, which is necessary for the tension, is always ensured by means of the automatically resulting best position of the separating element relative to the tensioning wheel. The tightening strap can be pretensioned with a very strong force by means of the self-adjusting "flying" arrangement of the separating element, which is sometimes also called high tension wedge, and it can thereby ensure a very rigid tightening of the package, which is required in particular when transporting heavy packed goods over longer distances.

After the two ends of the strap are tensioned against one another with the desired tensioning force in the described manner, the closing device is actuated, whereby the two ends of the strap are pressed rigidly on top of one another by means of a pressure or a friction plate before they are connected to one another. With plastic straps, the connection usually takes place by means of friction welding, as mentioned, whereby the friction plate moves the upper end of the strap with a high speed transversely to the longitudinal direction of the strap over the lower end of the strap to and fro, and the friction heat resulting therefrom melts the ends of the strap at their surface and welds them to one another in this way. Subsequently, the drive for the to and fro movement of the friction plate is shut down, but this is kept in its lowered position which presses the two ends of the strap together, in which it presses together the ends of the strap, which are under tension, and therewith their load capacity, until the weld connection has cooled down.

After the completion of the tightening in the described manner, the apparatus has to be removed from the package or from the tightening strap. For this, it is necessary to lift not only the pressure plate and the separating element far enough from the tensioning wheel, so as to be able to thread the ends of the strap lying there between laterally out of the apparatus, but first the pressure or the friction plate of the closing device has to be lifted from the two ends of the strap which are connected to one another, as otherwise a lateral threading of the ends of the strap from the apparatus is not possible. In particular with an apparatus, in which the tightening straps are pretensioned with a very strong pretension force, for example with an apparatus which comprises a hydraulic or pneumatic drive for the tensioning wheel, the pressure or friction plate is under a large tension after the connecting or welding of the two ends of the strap, which tension is exerted thereon from the upper end of the strap, which is pretensioned with regard to the lower end of the strap. That is, the pressure or the friction plate is held under tension by the upper end of the strap in the longitudinal direction of the apparatus, which results in that venting or lifting of the friction plate after connecting the ends of the strap is only possible with a large force. It has indeed already occurred with an apparatus, in which the closing device is opened (vented) manually by means of a manual lever, that the force necessary for lifting the pressure plate was so large that the manual lever did not withstand the loads and broke.

So as to ease the opening or venting of the closing device, the tensioning device is usually vented first, that is, the pressure plate and the separating element are lifted a little from the tensioning wheel, with the aim that the two ends of the strap which pass between these three parts will be disengaged from the tensioning wheel, the separating element and the pressure plate, so that the upper end of the strap is no longer under tension, and thereby the pressure or friction plate of the closing device is also relieved. It has been shown that with such an apparatus, in which the ends of the strap are tensioned against one another with a strong force, these do not disengage safely from the tensioning wheel and the pressure plate when venting, but stay at the rough or toothed surface and retain their mutual pretension, so that the pressure or friction plate of the closing device stays under tension and can only be lifted with difficulty, despite prior venting. The reason for this is that the pressure plate of the tensioning device can only be lifted a limited distance from the tensioning wheel, as the entire apparatus is pressed with a strong force against the package by the completed tightening. As the venting path of the tensioning device is limited, the separating element, which has moved during the tensioning under the tensioning wheel in the direction of the tip of the approximately wedge-shaped opening between the upper and lower ends of the strap, does not disengage or disengage completely from the ends of the strap, that is, it ensures that these cannot disengage from the surfaces of the tensioning wheel or the pressure plate which are roughened by means of teeth or barbs.

SUMMARY OF THE INVENTION

In accordance with the present invention, provided is a device for tensioning and closing tightening straps which avoids these disadvantages and ensures a relaxation of the tightening straps relative to one another after producing a connection laterally next to these, even when only a limited venting path is available between the pressure plate and the tensioning wheel in the tensioning device.

This is accomplished by a tensioning device according to the present invention which includes an unblocking element which displaces the separating element during the lifting of the pressure plate from its relative position to the tensioning roller or to the pressure plate approximately parallel to the two ends of the strap. With the help of such an unblocking element, the separating element is necessarily displaced during the venting of the tensioning device and is moved from the position which it has taken during the tensioning of the two ends of the strap against each other. The displacement of the separating element parallel to the longitudinal direction of the tightening results in that a relatively small opening width between the tensioning wheel and the pressure plate during the venting of the tensioning device between the tensioning wheel and the separating element on the one hand, and this and the pressure plate on the other hand, produces sufficiently large gaps, and the ends of the straps leave their frictional connection to the tensioning wheel or the pressure plate. In a particularly advantageous manner, the separating element can be displaced from the unblocking element in the approximately wedge-shaped gap which forms during lifting of the pressure plate in a direction pointing away from the tip of the wedge gap or the connecting point of the ends of the strap, that is in a region, in which the ends of the strap have a greater distance from one another.

A tensioning device according to one aspect of the present invention can include an unblocking element which essentially consists of a spring element engaging the separating element, which spring element is under a spring pretension and which also draws or presses the separating element, which is also called hold-up wedge, during the venting of the pressure plate from the wedge-shaped gap between the ends of the strap away from the tip of the wedge gap or the weld seam between the ends of the strap. An embodiment of the invention, in which the unblocking element consists essentially of a release wedge cooperating with a gliding surface of the separating element is of particular advantage. During the lifting of the pressure plate the gliding surface of the separating element reaches the oblique part of the release wedge and displaces thereby the separating element automatically forward out of the approximately wedge-shaped gap between the ends of the strap when the tensioning device is vented. The separating element is advantageously arranged at a carrier shoe carrying the pressure plate, which is moved transversely to the longitudinal direction of the tightening strap during the venting of the tensioning device and thereby lifts the pressure plate and the separating element simultaneously from the tensioning roller.

In accordance with another aspect of the present invention, the tensioning device includes a separating element which is conveniently designed as a separating plate with a curved surface which is adapted to the radius of the tensioning roller, whereby a safe hold of the upper end of the strap between the tensioning wheel and the separating element is effected and correspondingly high tensioning forces can be achieved. The pressure plate is preferably arranged in a fixed manner at the carrier shoe, while the separating element is mounted approximately parallel to the ends of the strap at the carrier shoe in a moveable manner. For this, it can engage a longitudinal hole with play, which is formed at the carrier shoe with a lateral mounting end, and can be secured therein by at least one securing bolt engaging an arresting opening in the securing end.

In accordance to yet another aspect of the present invention, the tensioning device includes an unblocking element which is preferably adjustable by means of an adjusting device, whereby the adjusting device can for example consist essentially of a set screw with which the relative position of the release wedge can be changed, or the pretension of a spring element serving as the unblocking element can be changed.

BRIEF DESCRIPTION OF THE DRAWINGS

The foregoing characteristics and advantages of the invention will in part be obvious and in part be pointed out more fully hereinafter in connection with the following description of preferred embodiments and the accompanying drawings, in which.

DESCRIPTION OF THE PREFERRED EMBODIMENTS

Figure 1:
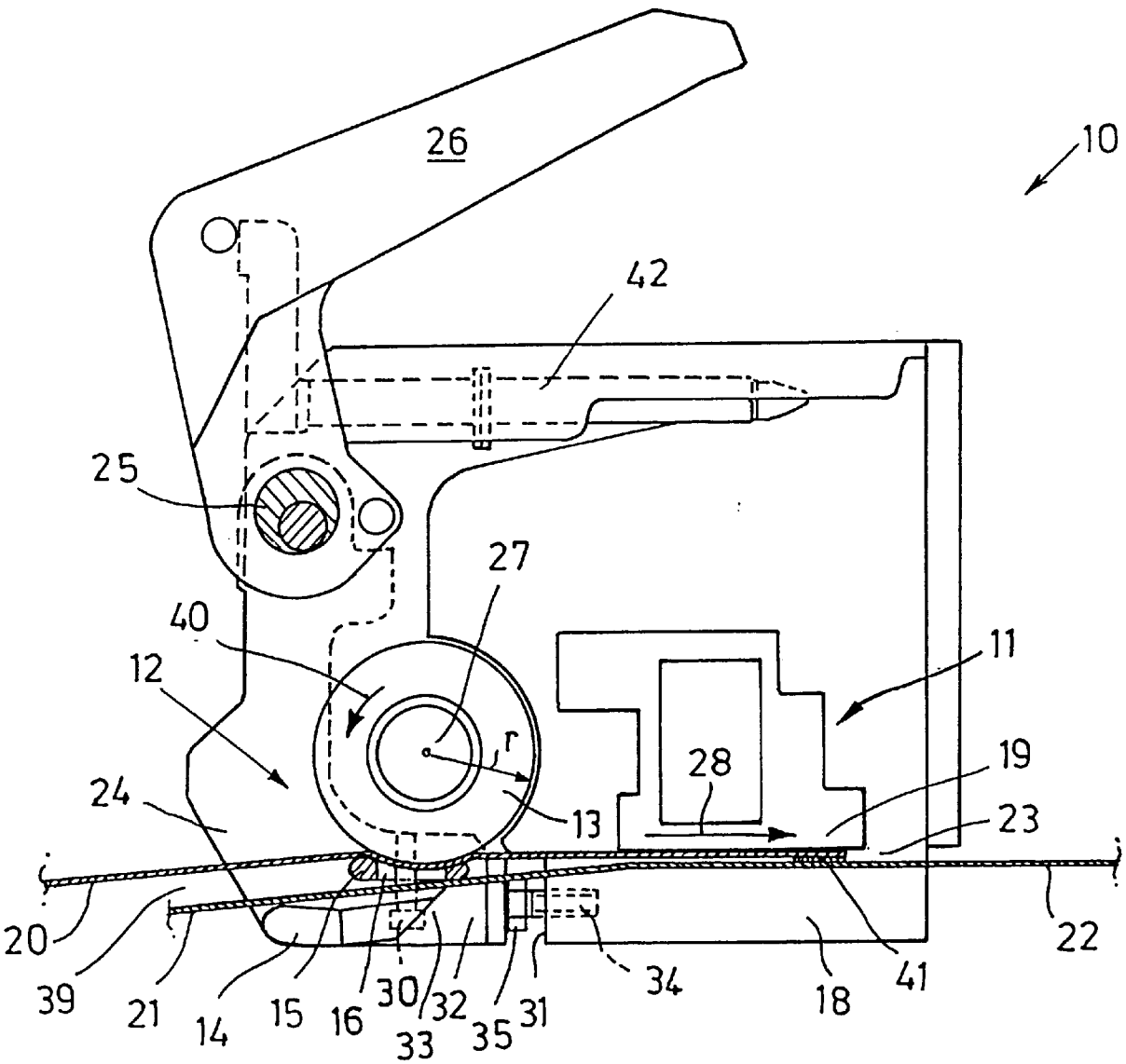
FIG. 1 is a partially sectioned elevational view of the side of a tensioning device according to the present invention for tensioning and closing of plastic tightening straps after welding the two ends of the strap.
Figure 2:
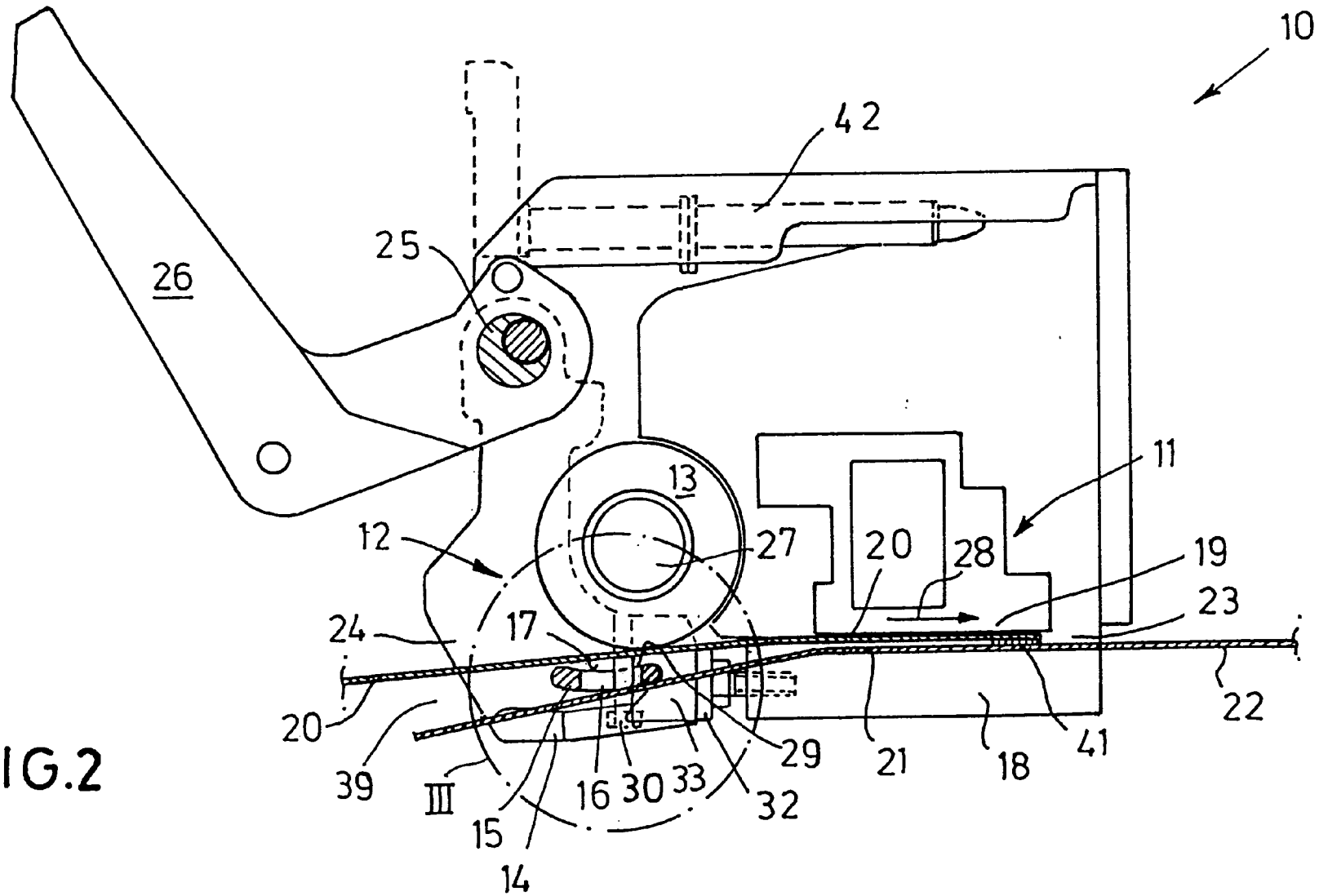
FIG. 2 is a partially sectioned elevational view of the side of the tensioning device shown in FIG. 1 with the handle in the forward position for venting of the tensioning device.
Figure 3:
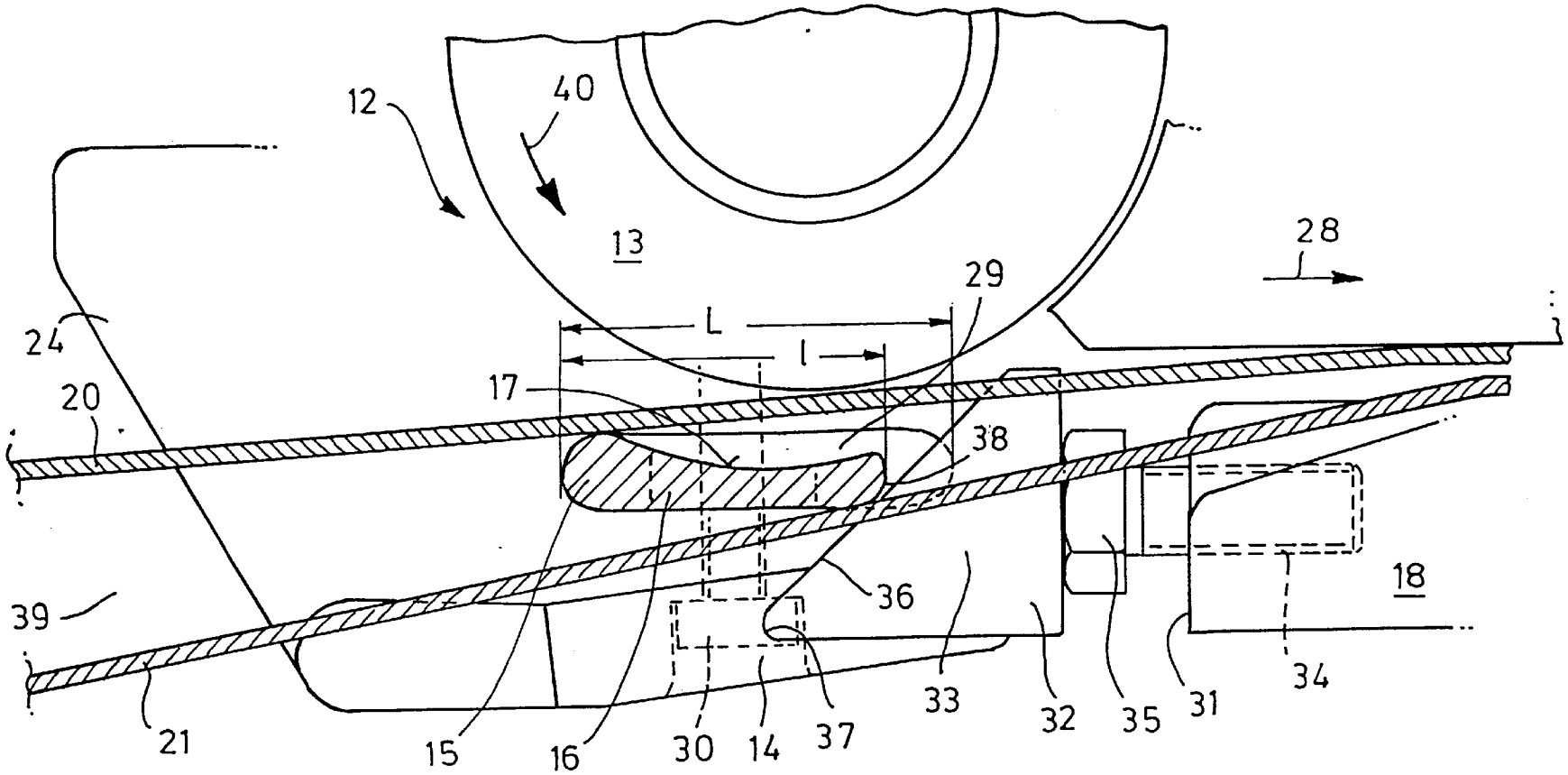
FIG. 3 is an enlarged partially sectioned elevational view of the tension device as is shown in FIG. 2.

Referring now in greater detail to the drawings wherein the showings are for the purpose of illustrating preferred embodiments of the invention only, and not for the purpose of limiting the invention, FIGS. 1–3 illustrate a tensioning and closing device 10 for the tensioning and closing of plastic tightening straps for producing package tightenings which can for example serve for securing the transport of packed pallets or the like. Tensioning device 10 comprises a closing device 11 and a tensioning device 12 which lies in front thereof in the longitudinal direction of the strap, which essentially consists of a tensioning wheel 13, which can be driven by means of a pneumatic drive, not shown in detail, a pressure plate 14, which can be moved against the tensioning wheel or can be lifted therefrom, and a separating element 15, which is arranged between these two parts, which is formed as a separating plate 16, and which comprises a curved surface 17, the curvature of which is adapted to the radius r of the tensioning wheel.

Closing device 11 essentially consists, in a known manner, of a lower abutment plate 18 and a friction plate 19, which is arranged above this in the housing and can be lowered, which can be moved to and fro along a vertical axis by means of a suitable drive in a way not shown and described in detail.

The two ends 20, 21 of the strap of a tightening strap 22 are inserted laterally into device 10 for producing a tightening. For this, the friction plate 19 is in its raised position, in which it forms a sufficiently large gap 23 with the abutment plate 18, so that the two overlapping ends 20, 21 of the strap can be inserted laterally between the friction plate and the abutment plate without being hampered. The pressure plate 14 and the separating element 15 are lifted from the tensioning wheel 13 for threading the ends of the strap into the tensioning device 12. The pressure plate is arranged in one piece at a carrier shoe 24, which is lowered at its upper end by means of an eccentric drive 25 by an actuating lever 26 when pivoting the lever forward, that is in the drawing anti-lockwise to the left relative to the axis 27 of the tensioning wheel 13, and which is lifted again when the actuating lever 26 is pivoted in the opposite direction, that is, clockwise. The pressure plate 14 arranged at the lower end of the carrier shoe 24 is moved thereby approximately transversely to the traversing direction of the ends 20, 21 of the strap, which are guided through the apparatus.

Separating plate 16 is also arranged at carrier shoe 24 and can be moved together with pressure plate 14 approximately transversely to the traversing direction 28 of the ends of the strap. A slot-shaped opening 29 is provided in the carrier shoe 24 for receiving the separating plate 16, the length L of which is larger than the length 1 of the separating plate. The separating plate is provided with a lateral projection, not seen in the drawing, which has a longitudinal hole, through which is inserted a securing bolt 30 projecting laterally through the slot-shaped opening 29. Thereby, the separating plate 16 cannot fall out of the slot-shaped opening 29 at the side, but it is arranged therein with play and can displace itself parallel to the traversing direction 28 as well as along an axis approximately parallel to the axis 27 of the tensioning wheel, and can adjust itself largely freely in its relative position to the tensioning wheel.

Lower abutment plate 18 of the closing device 11 is provided with an unblocking element 32 for separating plate 16 at its front face 31, which essentially consists of a release wedge 33, which is secured to the abutment plate 18 by means of a set screw 35, which is screwed into the front face 31 by means of a thread bore 34. The arrangement is in such a way that the oblique release surface 36 of the release wedge from the tip 37 of the wedge lying approximately under the tensioning wheel axis 27 increases obliquely upwards in the traversing direction 28 of the upper end of the strap 20 toward the closing device 11 which lies behind. The oblique release surface 36 cooperates with the rear edge of the separating plate 16, which forms a gliding surface 38, as can best be seen in FIG. 3. This results in that the separating plate is not only lifted radially from the tensioning wheel 13 by the carrier shoe 24, which is then moved downwards, as is usual in the state of the art according to FIG. 4*b*, but that is also additionally released from the release wedge approximately in the tangential direction of the tensioning wheel forward out of the wedge-shaped gap 39 formed by the ends 20, 21 of the strap against the traversing direction 28 of the upper end 20 of the strap.

For inserting the ends 20, 21 of the strap when producing a tightening, the pressure plate 14 and the separating plate 16 are lifted from the tensioning wheel 13 with the help of an actuating lever 26, which displaces the carrier shoe 24, into a position as seen in FIGS. 2 and 3. Therewith, the friction plate 19 has—as mentioned—a distance from the abutment plate 18 lying below, so that the ends of the strap can easily be inserted from the side of the apparatus. Subsequently, the actuating lever is pivoted into the position shown in FIG. 1 and lifts the carrier shoe 24 thereby, the upper end of the strap is clamped between the tensioning wheel 13 and the underlying separating plate 16, and the lower end of the strap is clamped between this and the pressure plate 14. Subsequently, the drive (not shown) for the tensioning wheel 13 is switched on, which rotates anti-clockwise in the direction of the arrow 40 and inserts the upper end 20 of the strap in the traversing direction 28 further into the closing device, while the lower end of the strap is held simultaneously by clamping it between the pressure plate 14 and the separating element 15. The separating plate 16 is also displaced during this tensioning process due to its floating mounting at the carrier shoe 24 in the traversing direction 28, and reaches the position shown in FIG. 1, in which it lies approximately under the axis 27 of the tensioning wheel 13, and with its curved upper surface 17 at the surface of the tensioning wheel periphery, with the upper end 20 of the strap in the intermediate position. As can easily be seen, the upper end of the strap lies over a relatively large region at the outer periphery of the tensioning wheel, so that large tension forces are exerted on the strap and this can be placed under a large tension, due to the large roughness of the tensioning wheel at its periphery and the large contact surface.

When the desired tension is reached, the drive for the tensioning wheel switches off and the friction plate 19 is lowered in a known manner onto the upper end 20 of the strap and moves this transversely to the traversing direction 28 with a high speed to and fro over the lower end 21 of the strap, so that the two ends of the strap fuse and are welded to one another, as is shown at 41.

After the hardening of the welding point 41 apparatus 10 has to be taken out from the finished tightening at the side. For this, it is necessary to lift the friction plate 19 on the one hand from the underlying ends of the strap, so as to release the gap 23 again, and on the other hand, to vent the tensioning device 12 in the manner described. Due to the high tension introduced into the strap by means of the tensioning wheel 13, the friction plate 19 is kept drawn after the welding in the direction of the tensioning wheel against the traversing direction 28 by the upper end 20 of the strap. This tension has such a magnitude that friction plate 19 can only be brought from its shown position into the lifted position by using a very large force. So as to decrease the force for lifting the friction plate, the tensioning device is first vented, with the aim to disengage the upper end of the strap from the tensioning wheel and thereby to decrease the forces exerted between the friction plate and the tensioning wheel by the upper end of the strap.

Figure 4A:
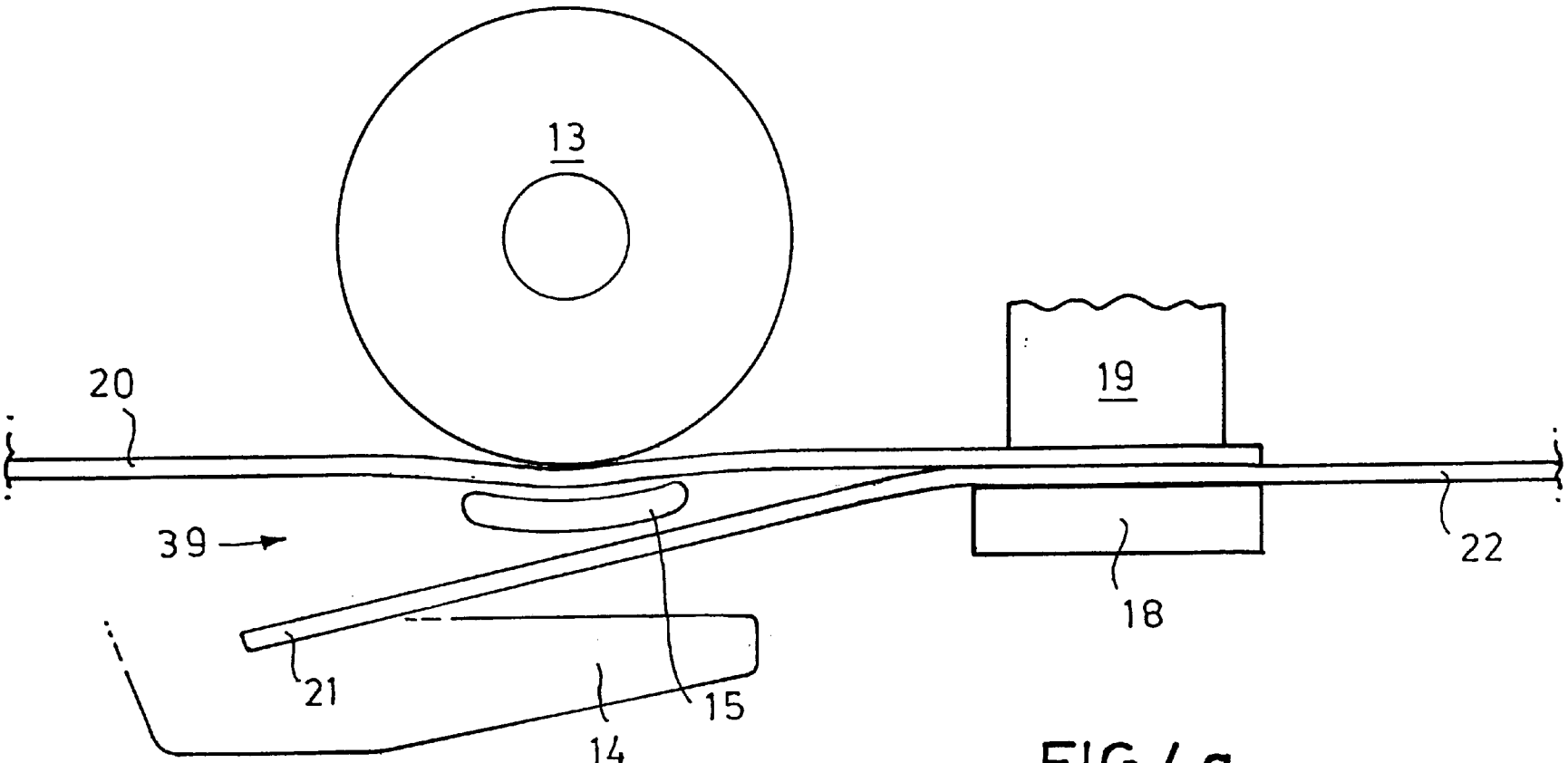
FIG. 4*a* is a principal diagram for illustrating the mode of operation the state of the art.

FIG. 4*a* shows the arrangement of the individual parts in a very simplified manner, as they are arranged to one another in the state of the art. It can be seen easily that the separating plate 16 is lifted a little from the tensioning wheel 13, but that the upper end 20 of the strap is still engaged with the tensioning wheel by means of a smaller radian measure, and will not be released sufficiently from the separating plate 16, so as to disengage from the rough surface of the tensioning wheel. The desired effect, that is the removal of the force acting on the friction plate 19 by means of the upper end of the strap, will not be achieved without the unblocking element 32 with an arrangement according to FIG. 4*b*.

Figure 4B:
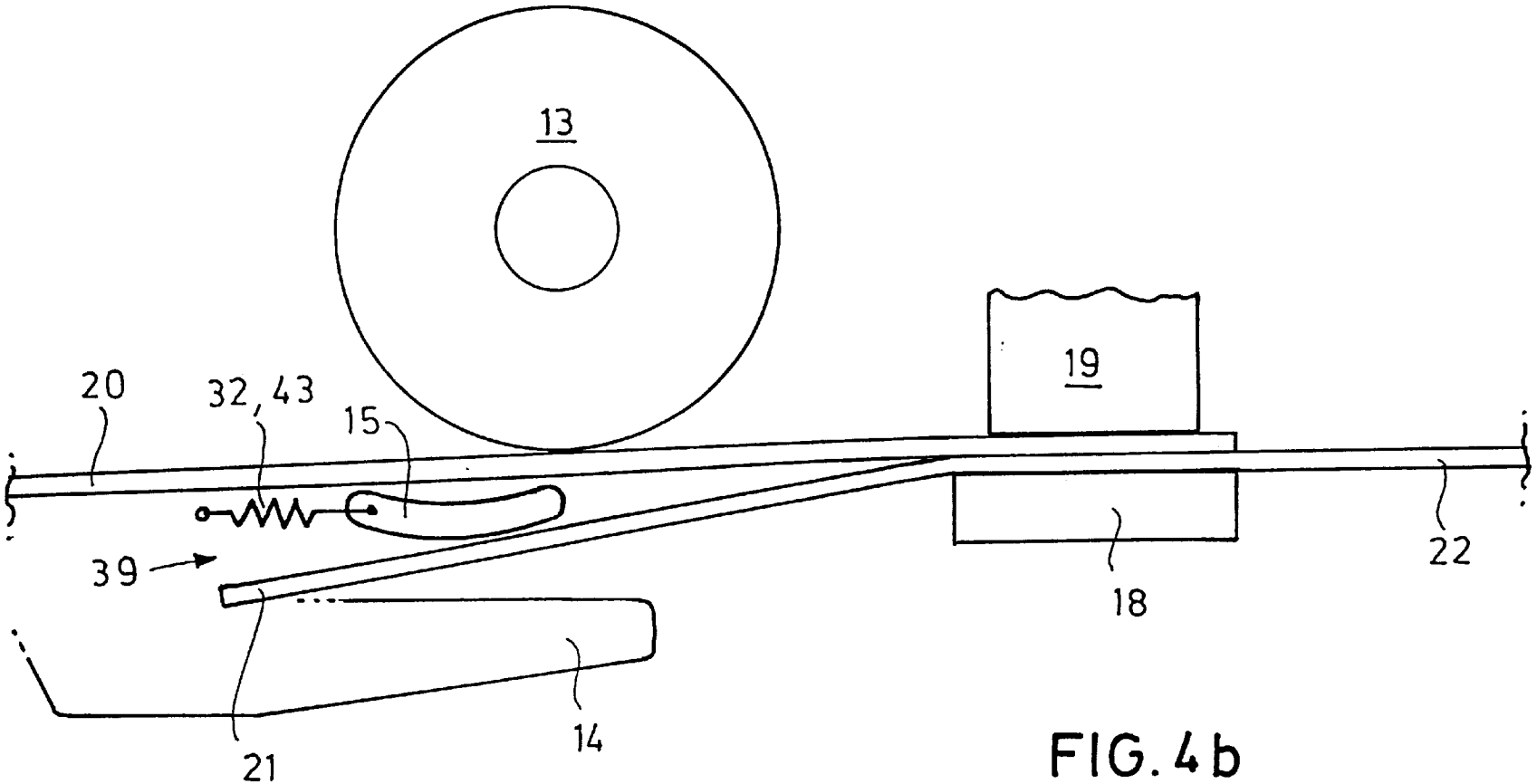
FIG. 4*b* is a principal diagram for illustrating the mode of operation for the invention of this application.

With the invention however, the separating plate 16 is, when the closing device 11 is ventilated, not only lifted radially from the tensioning wheel, but is also simultaneously displaced to the front with the help of the unblocking element 32 into the increasing wedge-shaped gap 39 between the ends of the strap, where it presses the upper end of the strap no longer against the tensioning wheel 13, so that it can disengage from the peripheral surface of the tensioning wheel and effect a relaxation of the friction plate 19. The friction plate can then easily be lifted in an essentially known manner with the help of a toggle gear, not shown, and a tappet 42 actuating this, and release the slot 23. The unblocking element 32 is shown in FIG. 4*b* as a screw tension spring 43 which draws the separating element 15 out of its effective engagement region below the tensioning wheel, when the wedge-shaped gap 39 is opened far enough by the lifting of the pressure plate 14 so as to release the separating plate.

While considerable emphasis has been placed on the preferred embodiments of the invention illustrated and described herein, it will be appreciated that other embodiments can be made and that many changes can be made in the preferred embodiments without departing from the principles of the invention. Accordingly, it is to be distinctly understood that the foregoing descriptive matter is to be interpreted merely as illustrative of the invention and not as a limitation.

What is claimed is:

1. An apparatus for tensioning and closing of a tightening strap for package tightenings, said apparatus comprising a closing device for connecting two ends of the strap and a tensioning device having a tensioning wheel that can be driven, a pressure plate which can be moved against said tensioning wheel or lifted from said tensioning wheel, and a self-adjusting separating element which is arranged between said tensioning wheel and said pressure plate, whereby one end of the strap is taken up between said tensioning wheel and said separating element, and the other end of the strap is taken up between said separating element and said pressure plate, said apparatus further including an unblocking element which displaces said separating element during said lifting of said pressure plate from said tensioning wheel, said displacement being approximately parallel to the two ends of the strap.

2. The apparatus according to claim 1, wherein said unblocking element includes a spring element which engages said separating element to displace said separating element.

3. The apparatus according to claim 1, wherein said unblocking element includes a release wedge which cooperates with a gliding surface of said separating element to displace said separating element.

4. The apparatus according to claim 1, wherein said separating element is arranged at a carrier shoe which carries said pressure plate.

5. The apparatus according to claim 1, wherein said tensioning roller has an outer radius and said separating element is formed as a separating plate with a curved surface which is adapted to said radius.

6. The apparatus according to claim 1, wherein said pressure plate is arranged in a fixed manner, and said separating element is arranged in a moveable manner at said carrier shoe approximately parallel to the strap ends.

7. The apparatus according to claim 1, wherein said separating element is retained in a longitudinal hole in said carrier shoe such that said separating element can move relative to said carrier shoe, said separating element being secured in said hole by at least one securing bolt which engages said separating element through an arresting opening and allows said relative movement.

8. The apparatus according to claim 1, wherein said unblocking element can be adjusted by an adjusting device.

9. The apparatus according to claim 8, wherein said adjusting device consists essentially of a set screw.

10. The apparatus according to claim 1, wherein an approximately wedge-shaped gap having an apex near said closing device is formed during said lifting of said pressure plate and said separating element can be displaced by said unblocking element in said gap in a direction pointing away from said apex.

11. The apparatus according to claim 2, wherein said separating element is arranged at a carrier shoe which carries said pressure plate.

12. The apparatus according to claim 3, wherein said separating element is arranged at a carrier shoe which carries said pressure plate.

13. The apparatus according to claim 2, wherein said separating element is retained in a longitudinal hole in said carrier shoe such that said separating element can move relative to said carrier shoe, said separating element being secured in said hole by at least one securing bolt which engages said separating element through an arresting opening and allows said relative movement.

14. The apparatus according to claim 13, wherein said unblocking element can be adjusted by an adjusting device.

15. The apparatus according to claim 3, wherein said separating element is retained in a longitudinal hole in said carrier shoe such that said separating element can move relative to said carrier shoe, said separating element being secured in said hole by at least one securing bolt which engages said separating element through an arresting opening and allows said relative movement.

16. The apparatus according to claim 15, wherein said unblocking element can be adjusted by an adjusting device.

17. The apparatus according to claim 2, wherein an approximately wedge-shaped gap having an apex near said closing device is formed during said lifting of said pressure plate and said separating element can be displaced by said unblocking element in said gap in a direction pointing away from said apex.

18. The apparatus according to claim 3, wherein an approximately wedge-shaped gap having an apex near said closing device is formed during said lifting of said pressure plate and said separating element can be displaced by said unblocking element in said gap in a direction pointing away from said apex.

19. The apparatus according to claim 7, wherein an approximately wedge-shaped gap having an apex near said closing device is formed during said lifting of said pressure plate and said separating element can be displaced by said unblocking element in said gap in a direction pointing away from said apex.

20. An apparatus for tensioning and closing of a tightening strap for package tightenings, said apparatus comprising a closing device for connecting two ends of the strap and a tensioning device having a tensioning wheel that can be driven, a pressure plate which can be moved against said tensioning wheel or lifted from said tensioning wheel, and a self-adjusting separating element which is arranged between said tensioning wheel and said pressure plate, whereby one end of the strap is taken up between said tensioning wheel and said separating element, and the other end of the strap is taken up between said separating element and said pressure plate, said apparatus further including an unblocking element which displaces said separating element during said lifting of said pressure plate from said tensioning wheel, said displacement being approximately parallel to the two ends of the strap, said separating element is arranged at a carrier shoe which carries said pressure plate, said tensioning roller has an outer radius and said separating element is formed as a separating plate with a curved surface which is adapted to said radius, said pressure plate is arranged in a fixed manner, and said separating element is arranged in a moveable manner at said carrier shoe approximately parallel to the strap ends, said separating element is retained in a longitudinal hole in said carrier shoe such that said separating element can move relative to said carrier shoe, said separating element being secured in said hole by at least one securing bolt which engages said separating element through an arresting opening and allows said relative movement, and an approximately wedge-shaped gap having an apex near said closing device is formed during said lifting of said pressure plate and said separating element can be displaced by said unblocking element in said gap in a direction pointing away from said apex.

* * * * *